US008714118B2

(12) United States Patent
Kaphammel

(10) Patent No.: US 8,714,118 B2
(45) Date of Patent: May 6, 2014

(54) BALANCED FIVE STROKE, FIVE CYLINDER BARREL CAM TYPE INTERNAL COMBUSTION ENGINE

(76) Inventor: Peter Kaphammel, Vernon (CA)

( * ) Notice: Subject to any disclaimer, the term of this patent is extended or adjusted under 35 U.S.C. 154(b) by 215 days.

(21) Appl. No.: 13/363,984

(22) Filed: Feb. 1, 2012

(65) Prior Publication Data

US 2012/0192838 A1 Aug. 2, 2012

Related U.S. Application Data

(60) Provisional application No. 61/462,313, filed on Feb. 1, 2011.

(51) Int. Cl.
*F02B 75/28* (2006.01)

(52) U.S. Cl.
USPC ..... 123/51 R; 123/56.1

(58) Field of Classification Search
CPC ..... F02B 75/02; F02B 75/26
USPC ..... 123/51 R, 56.1–56.9
See application file for complete search history.

(56) References Cited

U.S. PATENT DOCUMENTS

| | | | | |
|---|---|---|---|---|
| 1,613,116 | A * | 1/1927 | Michell | 123/51 BA |
| 1,788,140 | A | 1/1931 | Woolson | |
| 1,808,083 | A | 6/1931 | Tibbetts | |
| 2,080,846 | A * | 5/1937 | Alfaro | 123/51 B |
| 2,243,817 | A | 5/1941 | Herrmann | |
| 2,538,179 | A | 1/1951 | Weinhardt | |
| 4,090,478 | A | 5/1978 | Trimble et al. | |
| 4,492,188 | A | 1/1985 | Palmer et al. | |
| 4,565,165 | A * | 1/1986 | Papanicolaou | 123/51 BA |
| 4,996,953 | A * | 3/1991 | Buck | 123/51 A |
| 5,289,802 | A | 3/1994 | Paquette et al. | |
| 5,375,567 | A | 12/1994 | Lowi, Jr. | |
| 5,551,383 | A * | 9/1996 | Novotny | 123/51 BD |
| 6,305,334 | B1 | 10/2001 | Schuko | |
| 6,305,335 | B1 * | 10/2001 | O'Toole | 123/56.3 |
| 6,662,762 | B2 | 12/2003 | Schuko | |
| 7,124,716 | B2 | 10/2006 | Novotny | |
| 2003/0188701 | A1 * | 10/2003 | Daniel | 123/56.1 |

OTHER PUBLICATIONS

Robert O. Price, High torque, low-vibration Dyna-Cam hopes to barrel over the competition., Private Pilot, Aug. 1985, p. 60.

* cited by examiner

*Primary Examiner* — Hung Q Nguyen
(74) *Attorney, Agent, or Firm* — Antony C. Edwards

(57) ABSTRACT

A balanced five-stroke cycle, five cylinder engine, wherein the five cylinders are parallel and arranged around a shaft mounted in a centrally disposed bore in the engine block, wherein the shaft is parallel to the cylinders, wherein power pistons in the cylinders dwell motionless for the intake part of the cycle between the vacuum stroke and the compression stroke of each power piston; induction of the combustion mixture resulting from the partial vacuum created by the vacuum stroke of the power piston, and wherein the position of each power piston is governed by a power piston cam mounted on the shaft, the shaft and bore on the centroidal axis of symmetry of the radially spaced apart array of five cylinders corresponding to the pistons, the opening and closing of exhaust ports governed by an exhaust piston cam mounted on the shaft moving exhaust pistons along the cylinders.

5 Claims, 9 Drawing Sheets

BALANCED FIVE STROKE, FIVE CYLINDER BARREL CAM TYPE INTERNAL COMBUSTION ENGINE

CROSS REFERENCE TO RELATED APPLICATION

This application claims priority from U.S. Provisional Patent Application No. 61/462,313 filed Feb. 1, 2011 entitled, Balanced, 5-Stroke, 5 Cylinder, Barrel Cam Type, Internal Combustion Engine Called "Pentakam".

FIELD OF THE INVENTION

This invention relates to the field of internal combustion engines and in particular to a balanced, five stroke, five cylinder, barrel cam-type internal combustion engine.

BACKGROUND OF THE INVENTION

The prior art attempts at balancing an axially reciprocating barrel cam internal combustion engine of the 5-stroke, opposed-piston type is well documented by Schuko in U.S. Pat. No. 6,662,762, and I hereby incorporate that patent by reference in its entirety. Schuko describes a method of balancing a five stroke engine, such as disclosed by Woolson in U.S. Pat. No. 1,788,140, by the use of first and second cylinders, pistons and cams so configured as to counteract each other's reciprocating motions. The duplication of a number of components by Schuko increases the complexity of the Woolson engine, thereby, in applicant's view, compromising simplicity of construction. A problem in the Woolson patent disclosure was the spark-plug location being confined to a recess in the cylinder wall to allow the pistons to pass by it during the exhaust and dwell strokes of its cycle.

It should be noted that although Schuko uses the word "cycle" in his '762 patent, in the present disclosure the word "stroke" is used instead, as in the Balanced 5 Stroke Engine referred to in the title hereto. The word "cycle" as used within the present disclosure refers to the set of five strokes in operation of the engine, which five strokes constitute a repeating "cycle". Furthermore it should be noted that Woolson's use of the words "cycle" and "stroke" in his '140 patent are consistent with their use and meaning in the disclosure of the present invention.

SUMMARY OF THE INVENTION

The internal combustion engine of the present invention combines a five-stroke cycle within a five cylinder arrangement that results in axial, dynamic balance of the reciprocating components, conserving simplicity of construction. The simplicity of construction results in the use of a minimum number of moving parts.

The engine of the present invention provides a balanced operation by using a five-stroke cycle within a five cylinder arrangement which in combination results in an axially balanced engine of simplicity wherein the power pistons dwell motionless for the intake part of the cycle between the vacuum stroke and the compression stroke of each power piston; induction resulting from the partial vacuum created by the vacuum stroke of the power piston, and wherein the position of such power piston is governed by a cam mounted on a shaft which runs along the centroidal axis of symmetry of the radially spaced apart array of five cylinders corresponding to the pistons.

In summary the engine according to the present invention may be characterized in one aspect as including an engine block having a longitudinal dimension and a diameter dimension orthogonal to the longitudinal dimension, wherein the engine block has a linear shaft bore running therethrough along a centroidal axis of symmetry of the block from a power piston end of the block to an opposite exhaust piston end. A radially spaced array of five cylinders is formed in the block, equally radially spaced around, and equally radially distal from, and parallel to the shaft bore. A power piston cam cavity is formed in the power piston end of the block. The power piston cam cavity connects the shaft bore with the array of five cylinders. An exhaust piston cam cavity is formed in the exhaust piston end of the block and connects the shaft bore with the array of five cylinders.

Five power pistons are slidably mounted is the power piston ends of the array of five cylinders. Five exhaust pistons are slidably mounted in the exhaust piston ends of the array of five cylinders. Each of the power pistons and each of the exhaust pistons have combustion chamber faces in opposed facing relation within each corresponding cylinder so as to define a combustion chamber between the opposed facing combustion chamber faces. Each of the power pistons has a power piston cam channel formed therein and disposed in registry with the power piston cam cavity. Each of the exhaust pistons has an exhaust piston cam channel formed therein and disposed in registry with the exhaust piston cam cavity.

A power piston cam having an arcuately profiled substantially disc-shaped power piston cam member there-around, is mounted to a shaft rotatably mounted in the shaft bore for rotation therewith. The power piston cam is rotatably mounted in the power piston cam cavity so as to slidably mate the power piston cam member simultaneously with the power piston cam channels in each power piston. An exhaust piston cam having an arcuately profiled substantially disc-shaped exhaust piston cam member there-around is mounted to the shaft for rotation therewith and rotatably mounted in the exhaust piston cam cavity so as to slidably mate the exhaust piston cam member simultaneously with the exhaust piston cam channels in each exhaust piston. The power piston cam member is arcuately profiled according to a power piston stroke profile to translate the power pistons during a repeating five phase cycle of the engine along corresponding cylinders as the shaft rotates relative to the block. The exhaust piston cam member is arcuately profiled according to an exhaust piston position profile to translate the exhaust pistons during the five phase cycle of the engine along the corresponding cylinders as the shaft rotates relative to the block. Each cylinder has an intake port and a corresponding exhaust port formed in a wall of each cylinder. The intake port is positioned to coincide in position with the combustion chamber during an intake dwell phase of the five phase cycle of the engine. The five stroke cycle for each cylinder is 72 degrees out-of-phase to the five stroke cycle for its next adjacent cylinder in the array of five cylinders so as to provide for balanced operation of the engine.

The five phase cycle includes, in repeating sequence: the intake dwell phase, a compression stroke phase, a power stroke phase, an exhaust stroke phase, and a vacuum stroke phase. In the intake dwell phase for each cylinder the piston is translated according to the stroke profile to an intake port open position wherein a corresponding intake port is open and the exhaust piston is maintained by the positioning profile in a exhaust port closed position wherein a corresponding exhaust port is closed so that a combustion mixture fills the combustion chamber from the intake port. In the compression stroke phase for each cylinder the power piston is translated according to the stroke profile to a fully compressed position wherein the combustion chamber is fully compressed for ignition of the combustion mixture in the combustion chamber, and the exhaust piston is in the exhaust port closed position. In the power stroke phase for each cylinder the power piston is translated to a power-from-combustion depleted position wherein the combustion chamber is expanded without opening the intake port to thereby transfer energy from combustion of the mixture following the ignition to rotation of the shaft via each piston urging in sequence rotation of the power piston cam, and the exhaust piston is in the exhaust port closed position. In the exhaust stroke phase for each cylinder the power piston is translated to substantially the fully compressed position and the exhaust piston is translated to an exhaust port open position wherein the exhaust port is exposed to vent therethrough by-products of combustion from the ignition of the mixture in the combustion chamber. In the vacuum stroke phase for each cylinder the power piston returns to the intake port open position and the exhaust piston returns to the exhaust port closed position.

In one embodiment the shaft is solid and the ports are in fluid communication directly to an exterior of the engine. In a further embodiment the shaft is hollow so as to form a linear intake and exhaust conduit and wherein the shaft has apertures formed around the conduit coinciding in longitudinal position with the ports, and wherein the ports are in fluid communication with the conduit via the apertures as the shaft rotates, and wherein the intake and exhaust ports are blocked from fluid communication with one another through the conduit by a conduit plug so that intake of combustion mixture is through end of the conduit and exhaust is expelled through an opposite end of the conduit. In one embodiment the conduit plug may have substantially conical, frusto-conical or otherwise flow deflecting faces on opposite ends of the plug to smooth gaseous flow between the conduit and combustion chamber via the apertures in the conduit. Each cylinder may further comprise an igniter port adjacent a corresponding the exhaust port, and include an igniter mounted in each igniter port, wherein each igniter extends into its corresponding combustion chamber from the igniter port.

BRIEF DESCRIPTION OF THE DRAWINGS

In the drawings wherein like reference numerals denote corresponding parts in each view.

DETAILED DESCRIPTION OF EMBODIMENTS OF THE INVENTION

Figure 1A:
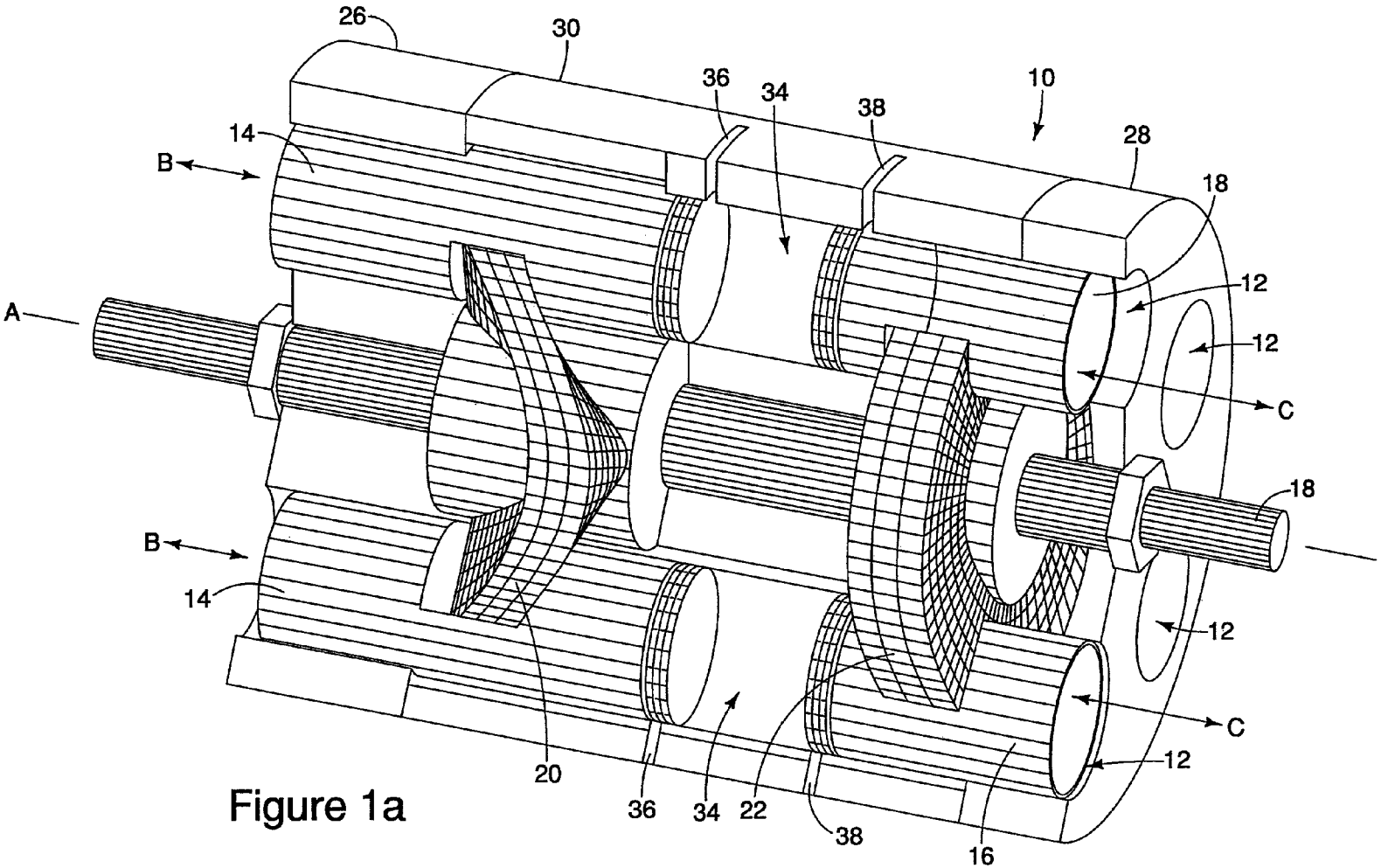
FIG. 1*a* is a perspective partially cut-away view of the engine according to the present invention.
Figure 1B:
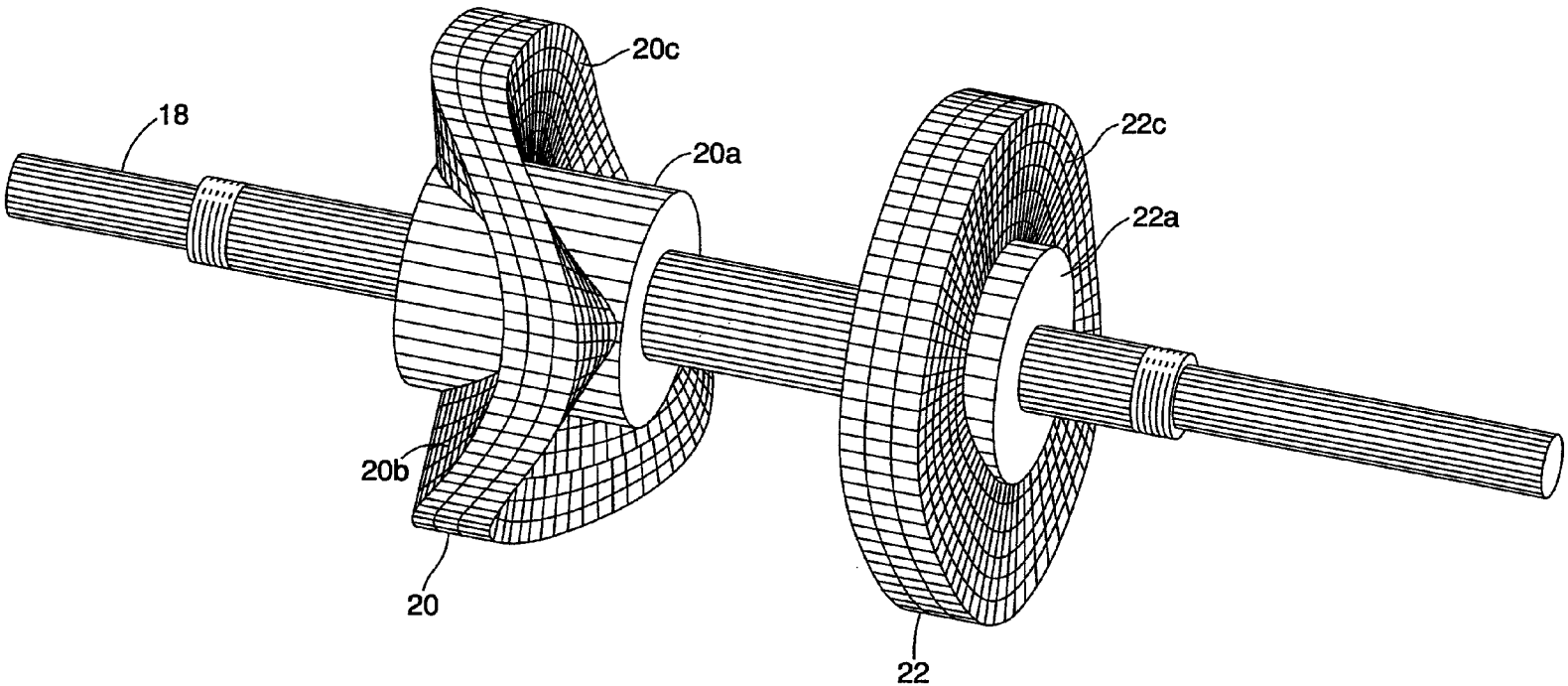
FIG. 1*b* is the view of FIG. 1*a* showing the cams and shaft.
Figure 1C:
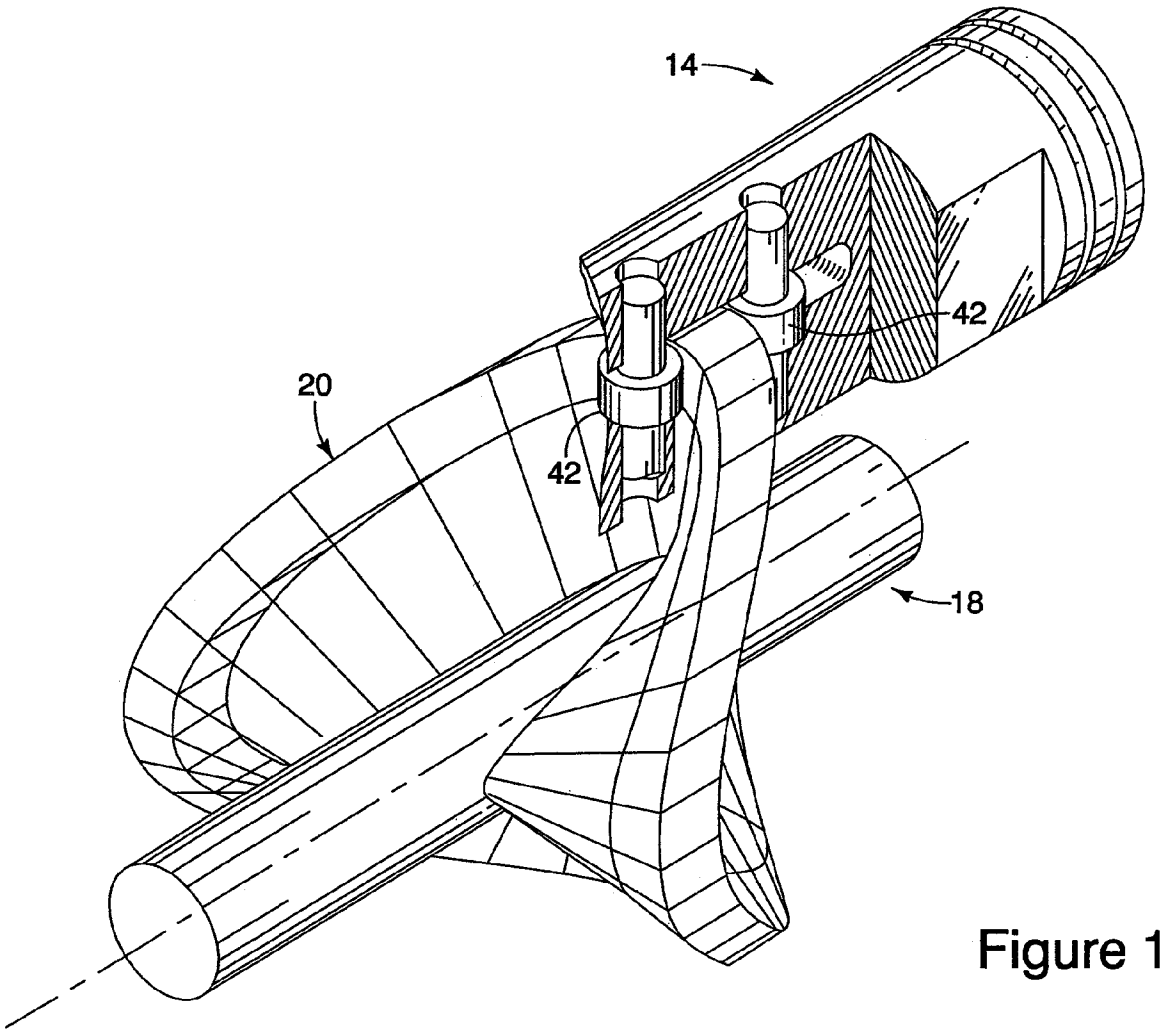
FIG. 1*c* is, in partially cut-away perspective view, the power cam according to one embodiment driving a piston along the cam profile, wherein a pair of rollers provide the cam followers.
Figure 2:
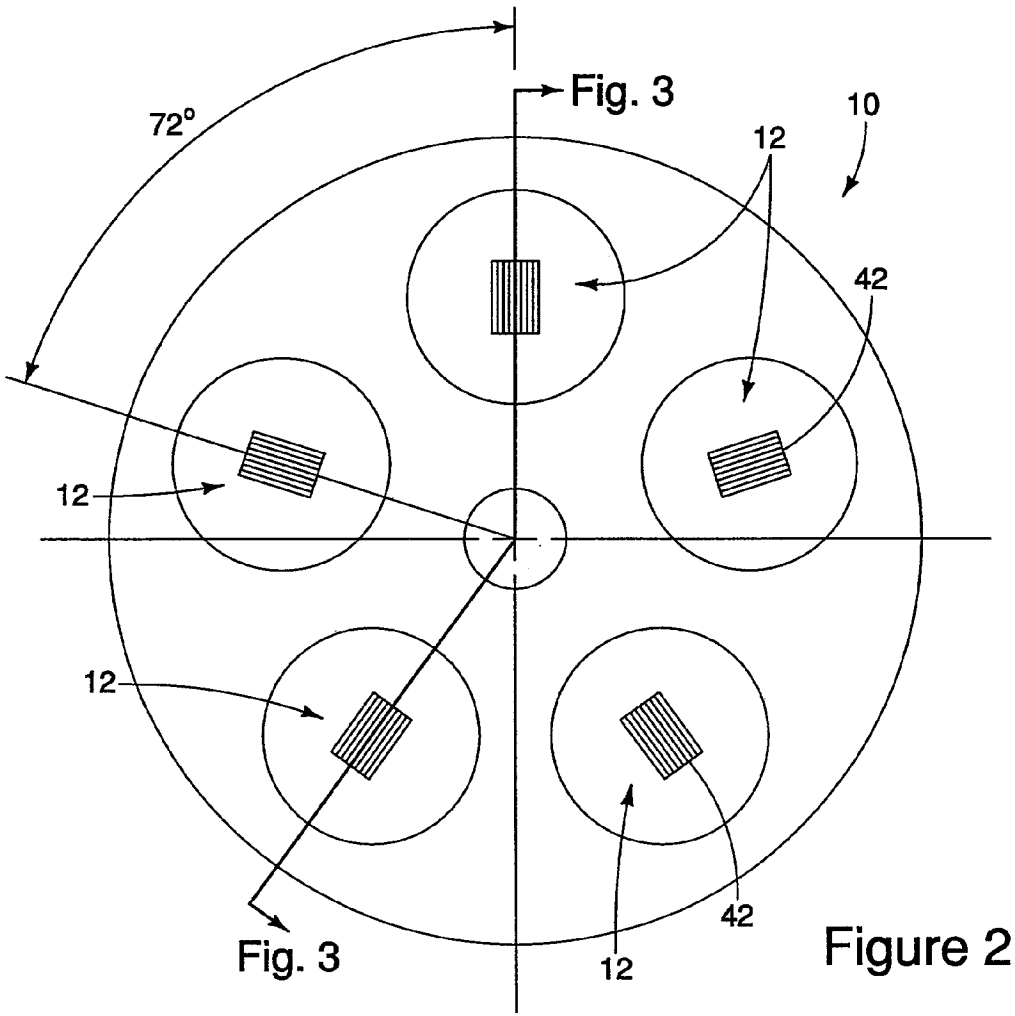
FIG. 2 is an end view of the engine showing the five cylinders equally radially spaced about the central axis of rotation resulting in 72 degrees of angular separation between each cylinder.
Figure 3:
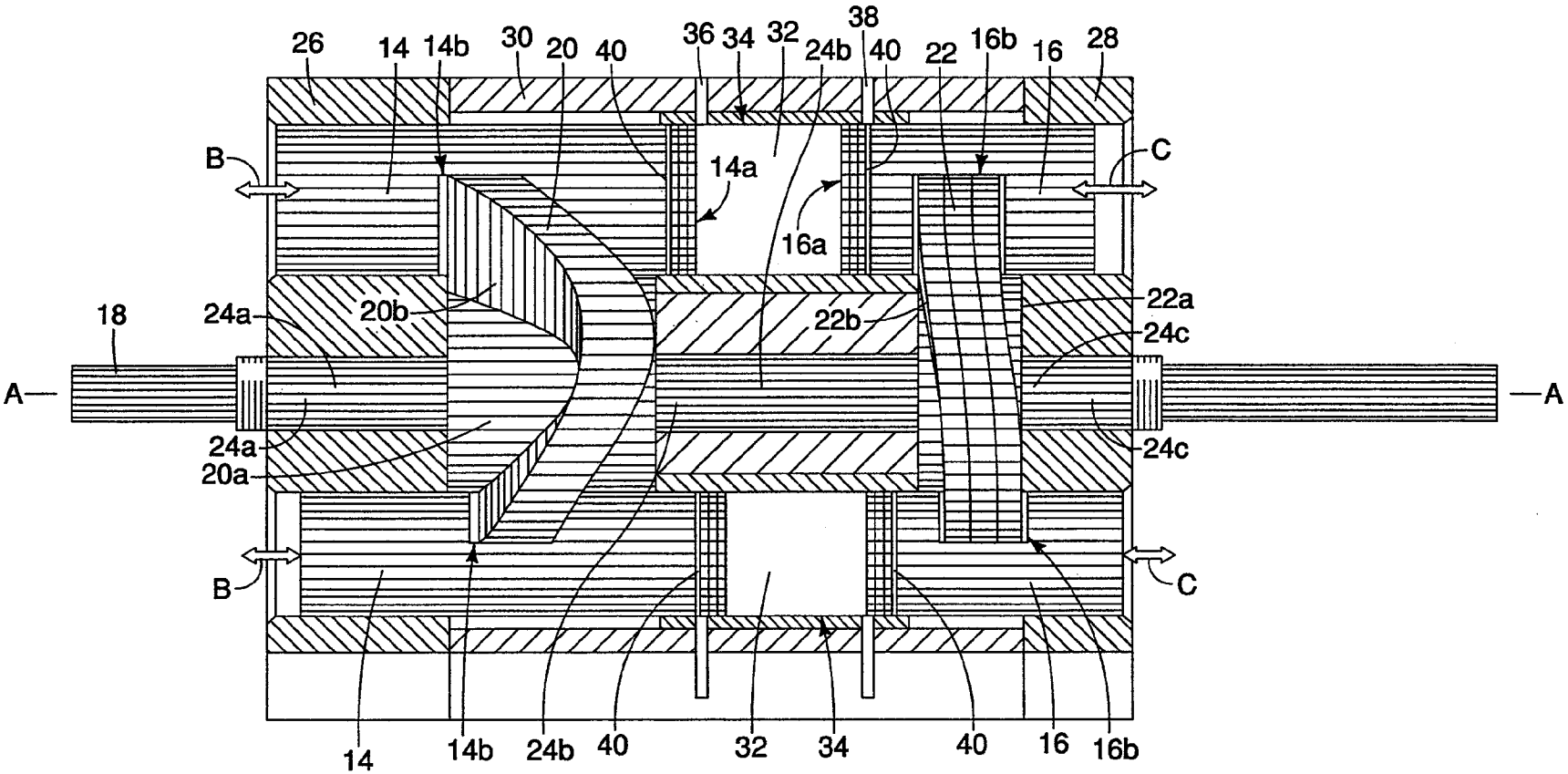
FIG. 3 is a sectional view along line 3-3 in FIG. 2.

In engine 10, each of the five cylinders 12 contains a power piston 14 and an exhaust piston 16. Cylinders 12 are radially equally spaced apart around the centre shaft 18 and are parallel to each other. It will be noticed that the power pistons dwell motionless for the intake part to each cycle. Induction results from the partial vacuum created by the vacuum stroke.

Power cam 20 and exhaust cam 22 are mounted spaced apart along shaft 18 on corresponding collars 20*a* and 22*a* respectively. Collars 20*a* and 22*a* are held in position rigidly mounted onto shaft 18, for example by means of a spline mounting along the shaft, by the use of spacers 24*a* on the power piston side of the engine, spacer 24*b* in the centre position between the power and exhaust cams, and spacer 24*c* on the exhaust cylinder side of the engine.

The five cylinders 12 are formed by aligned, that is, coaxial bores formed in power-side and exhaust-side cylinder blocks 26 and 28 respectively, sandwiching therebetween a centre cylinder block 30. A cylinder insert 32 is mounted in so as to form a lining of each of cylinders 12 within centre cylinder block 30 in a position substantively coinciding with the combustion chamber 34 for each cylinder, wherein, the combustion chamber is positioned between the intake port 36 and the exhaust port 38 for each cylinder 12. The combustion chamber 34 for each cylinder is generally defined as the void between the opposed facing power and exhaust piston faces 14*a* and 16*a* respectively which in conjunction with piston rings 40 seal combustion chambers 34.

Power cam 20 and exhaust cam 22 rotate along with shaft 18 about axis of rotation A. As power cam 20 rotates on shaft 18, power cam 20 passes through guide channels 14*b* formed in each of power pistons 14. As the opposite load-bearing faces 20*b* and 20*c* of power cam 20 rotate with rotation of shaft 18 about axis A, rollers 42 mounted onto opposite sides of channels 14*b* bear against load bearing surfaces 20*b* and 20*c* of power cam 20 so as to convert the angular or rotary motion of power cam 20 to axial translation of power pistons 14 longitudinally in direction B along the power piston side of the corresponding cylinder 12.

Similarly, exhaust cam 22 as it rotates with shaft 18 passes through guide channels 16*b* in exhaust piston 16. In particular, the opposite load hearing faces 22*b* and 22*c* of exhaust cam 22 bear against rollers 42 which act as cam followers mounted in the opposite sides of guide channels 16*b* of each exhaust piston 16. Thus the rotary or angular motion of exhaust cam 22 as it rotates about axis A on shaft 18, is converted into corresponding linear translation of exhaust pistons 16 in the direction C longitudinally along the exhaust side of each corresponding cylinder 12.

Thus as will be understood by those skilled on the art, the curved profile of power cam 20 and the curved profile of exhaust cam 22 dictates the instantaneous position of the power and exhaust pistons 14 and 16 respectively as shaft 18 rotates about axis of rotation A. The profile of power cam 20 thus moves each power piston independently of each other power piston to accomplish the five "strokes" of each cycle, that is, for each one revolution of power cam 20.

Figure 4:
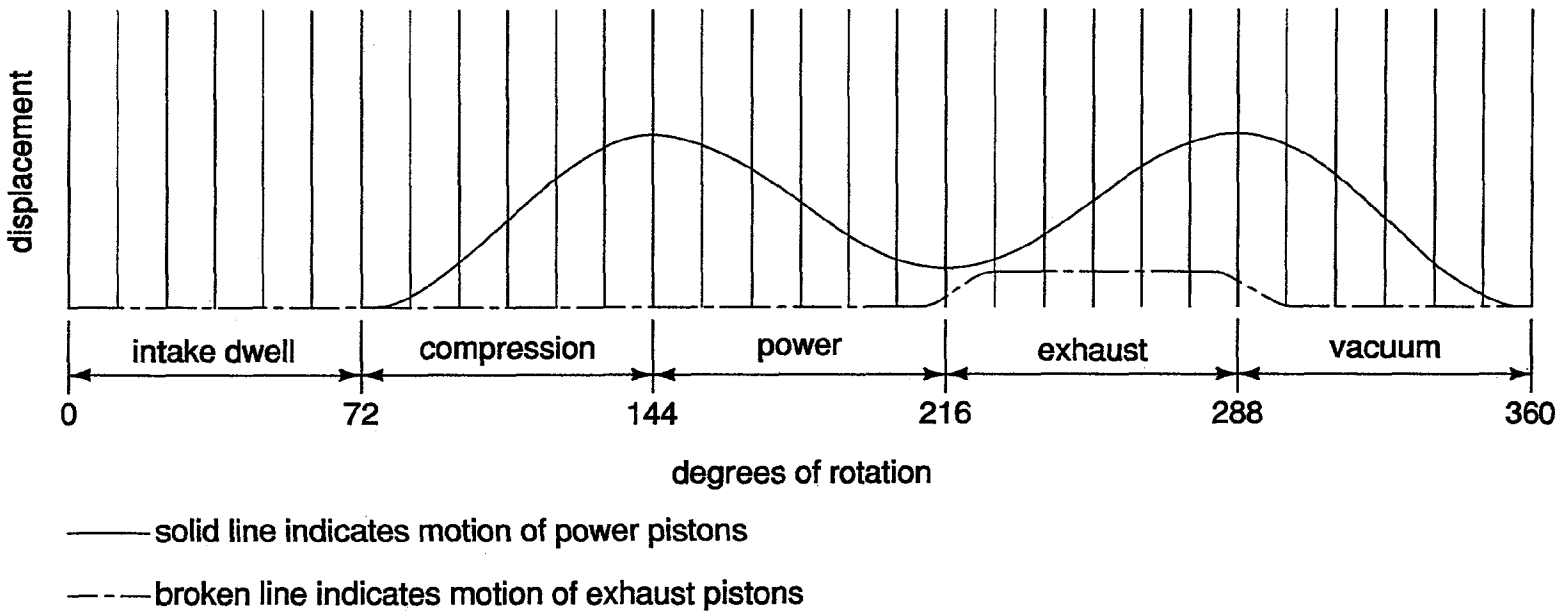
FIG. 4 is a graphical representation of the five strokes of the engine that constitute one cycle, wherein the strokes are labelled, in sequence: intake dwell (which is an absence of piston motion rather than a "stroke"), compression stroke, power stroke, exhaust stroke, and vacuum stroke.
Figure 5:
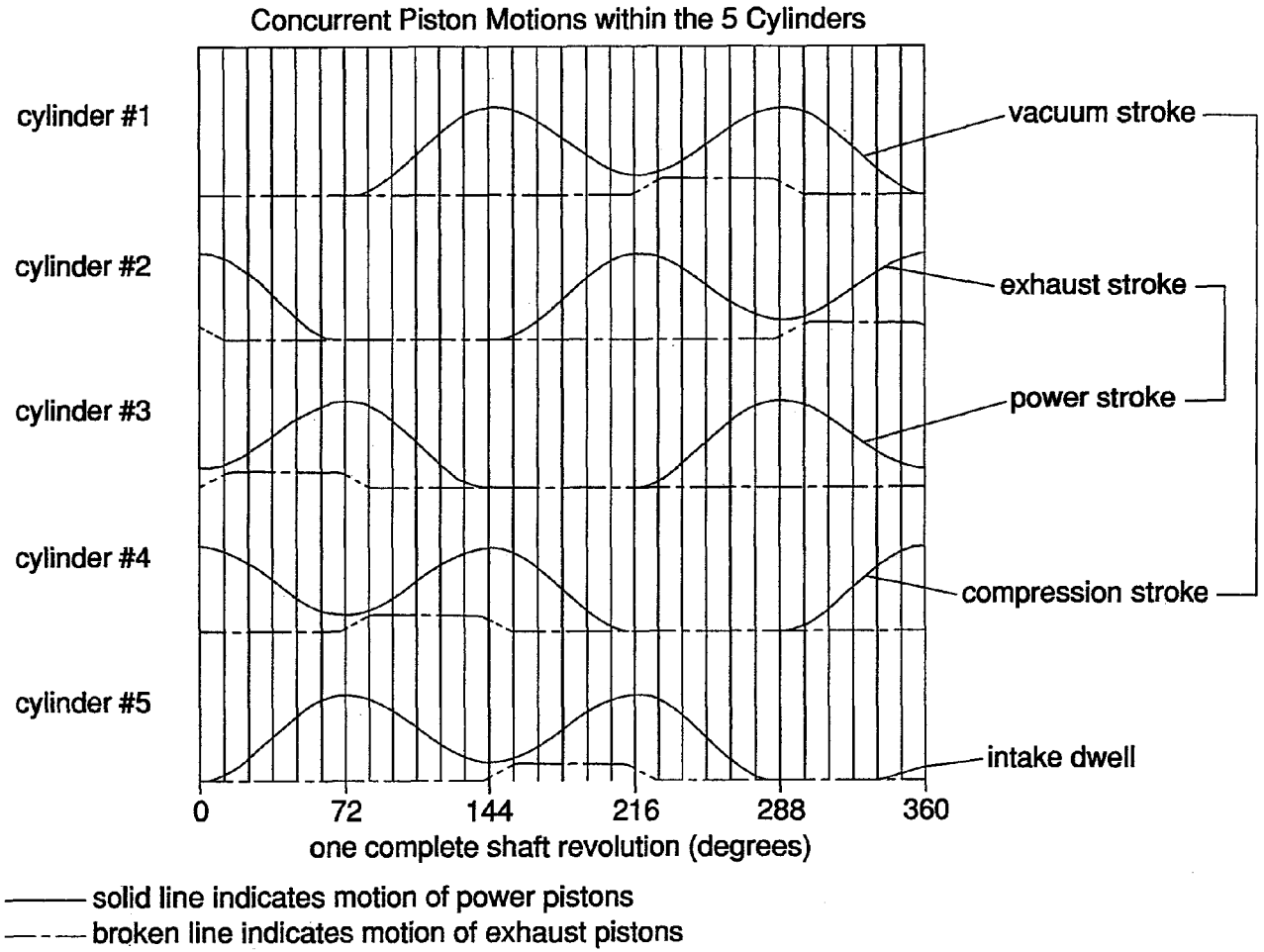
FIG. 5 is a graphical representation of the five-piston concurrent motions aligned in a table one over the other for ease of understanding of the relative positions of the pistons during each piston's cycle wherein in both FIGS. 4 and 5 solid lines indicate the position of the power pistons and the broken lines indicate the positions of the exhaust pistons.

A single cycle of one power piston and its corresponding exhaust piston is shown in FIG. 4. FIG. 5 juxtaposes the cycle profile of FIG. 4 for the simultaneous operation of five cylinders. Thus it may be seen, and as will be understood by those skilled in the art, the displacement of the power and exhaust cylinders during their corresponding vacuum stroke, power stroke, compression stroke, and intake dwell (during which neither the power or exhaust pistons for that particular cylinder move during the corresponding 72 degrees of angular rotation), provide for continuous and balanced power generation by combustion within the combustion chamber 34 for each cylinder 12.

During the exhaust stroke for each cylinder the exhaust piston is translated so as to expose the exhaust port and the power cylinder simultaneously translated to close the intake port and drive the products of combustion from the exhaust port. During the vacuum stroke the power piston translates so as to expose the intake port and the exhaust piston is translated so as to close the exhaust port. During the intake dwell, neither piston moves so as to provide for intake of the uncombusted fuel and air mixture. During the compression stroke the power piston translates so as to reduce the volume of the combustion chamber and thereby compress the fuel and air mixture while closing of the intake port, and while simultaneously the exhaust piston maintains the exhaust port closed. At maximum compression the fuel air mixture ignites or is ignited by for example a spark plug 44 or like igniter positioned between the intake and exhaust ports and preferably positioned adjacent the exhaust port. In preferred embodiments the igniter, for example, the spark plug extends into the combustion chamber for improved burn efficiency, during which the fuel air mixture is ignited and the power stroke commences as the power piston is driven away from the exhaust piston. The exhaust piston maintains the exhaust port closed while the power stroke drives rotation of the shaft 18 about axis A.

Figure 6:
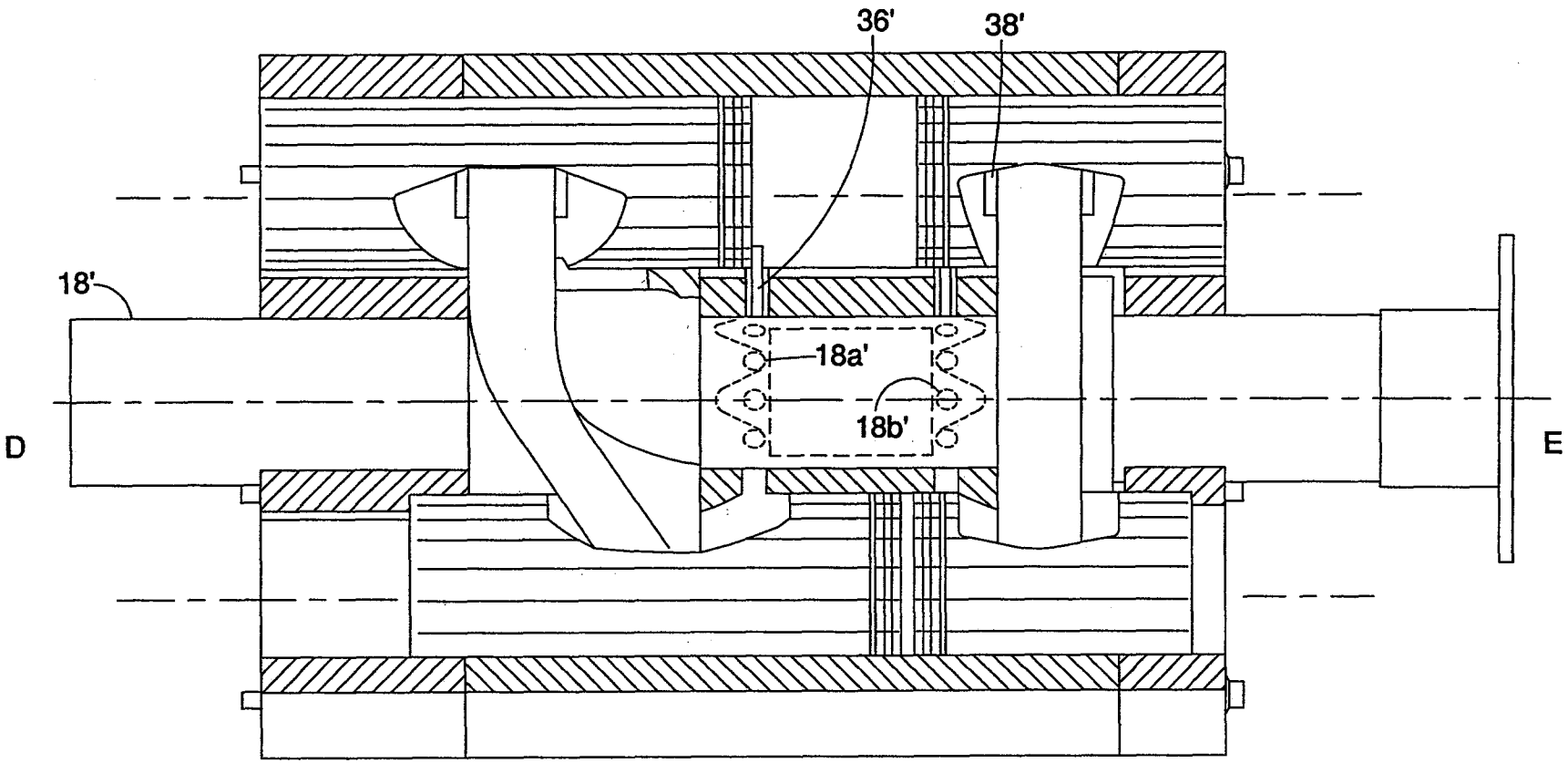
FIG. 6 is in partially cutaway view, a further embodiment of the engine of FIG. 1*a*, wherein the solid shaft is replaced with a hollow shaft.

In the illustrated embodiment of FIG. 1*a*, shaft 18 is a solid shaft and the intake and exhaust ports 36 and 38 respectfully are formed as gaps between the power side cylinder block 26 and centre cylinder block 30, and exhaust side cylinder block 28 and centre cylinder block 30 respectively spaced around the exterior circumference of engine 10. In the preferred embodiment of FIG. 6, solid shaft 18 is replaced with hollow shaft 18' which has a circumferential array of apertures 18*a*' which align with intake ports 36' radially inside surfaces of cylinders 12, and a circumferential array of apertures 18*b*' which align with corresponding exhaust ports 38' again on the radially inside surfaces of cylinders 12. This arrangement improves the simplicity of engine 10 by removing the requirement of intake and exhaust manifolds (not shown) that would be required external to engine 10 to connect to the externally formed intake ports 36 and exhaust ports 38. In the embodiment of FIG. 6, the fuel air mixture flows through shaft 18' in direction D from a fuel air mixture intake (not shown) leading from the engine carburation system (also not shown). The products of combustion from the combustion chambers exhaust through exhaust ports 38' and corresponding apertures 18*b*' in shaft 18' to exit in direction E as exhaust from engine 10.

Figure 7:
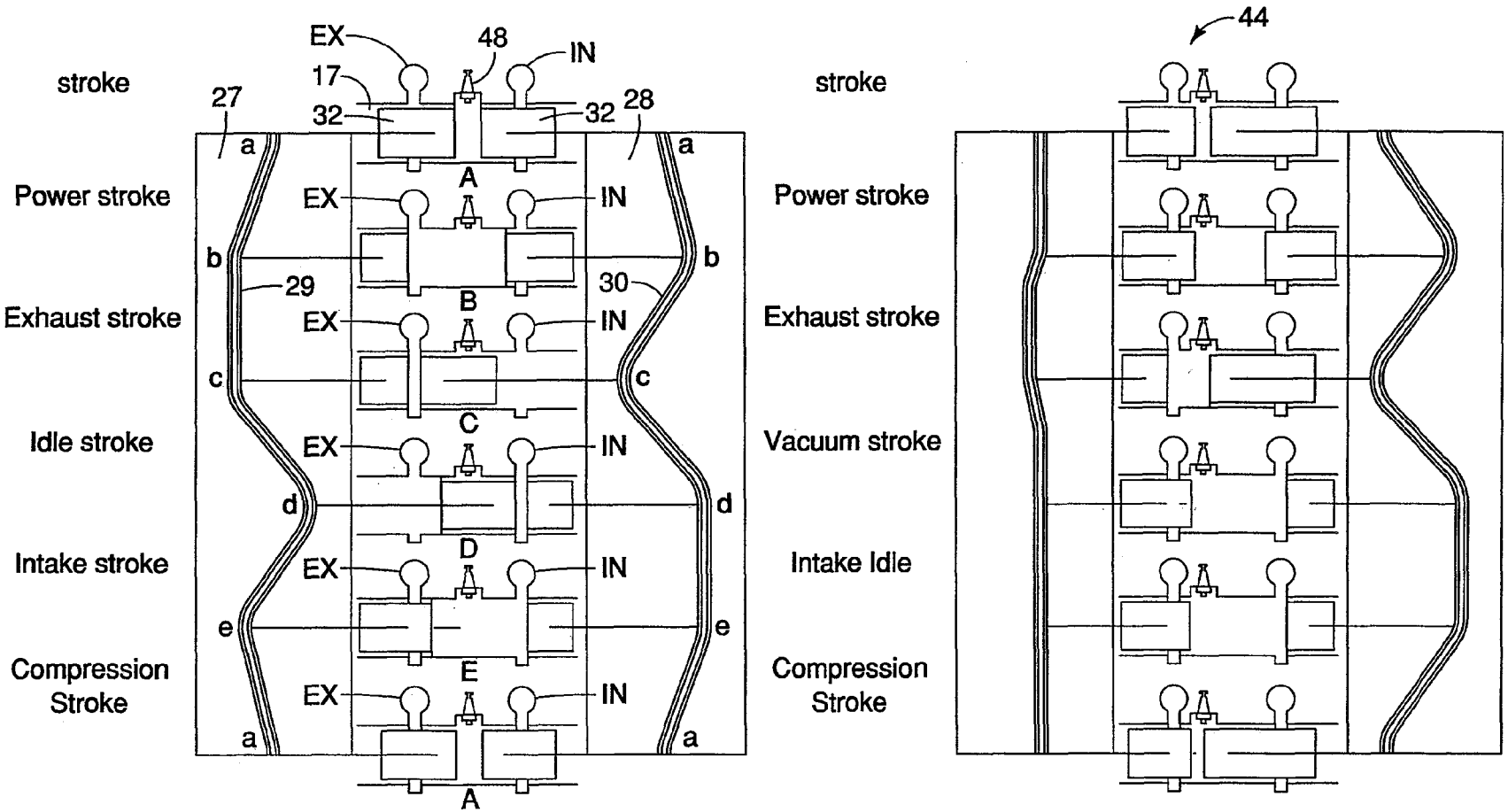
FIG. 7 is a side-by-side comparison chart of the engine cycle comparing U.S. Pat. No. 1,788,140, Woolson, on the left side of the chart to the cycle of the engine according to the present invention on the right side of the chart.

The embodiments of FIGS. 1*a* and 6, thus provide a further advantage over the prior art of Woolson, U.S. Pat. No. 1,788,140, in that, in Woolson, because of the piston movement the spark plugs had to be recessed into ports in the side walls of the cylinders, whereas, with the power and exhaust cylinder movements according to the present invention, and with the spark plug located near the exhaust port in each cylinder, the tip of the spark plug or other igniter 44 may now protrude into the combustion chamber 34 within cylinder 12 to thereby improve the efficiency of combustion as may be better understood by a review of the comparison illustrated in FIG. 7.

Thus as will now be understood, the equal and opposite power piston motions of vacuum and compression, as well as exhaust and power strokes according to the present invention result in axial dynamic balance. The exhaust piston motions are also dynamically balanced by concurrent equal and opposite motions. The power pistons have balanced motion separate from the balanced motions of the exhaust pistons.

As seen in FIGS. 4 and 5, each one of the five strokes of the engine cycle is of equal duration, that is 72 degrees of angular rotation of shaft 18. This is a necessary requirement for complete dynamic balance as the cylinders have 72 degrees of angular separation. This combination allows for each motion in one cylinder to be counteracted by an opposite motion in another cylinder.

The power and exhaust cam profiles are contoured to provide the five stroke engine cycle illustrated in FIG. 5. A variety of profiles may be applied, such as a sinusoidal or cycloidal shape but, whichever is chosen, the same profile must be applied to both stroke pairs that are to balance each other dynamically. That is the exhaust stroke profile must be identical and opposite to the power stroke profile and the compression and vacuum stroke profiles must be identical and opposite for complete axial dynamic balance. The same applies to the exhaust cam profile to preserve axial dynamic balance.

Although the preferred embodiment for the sake of simplicity of construction is a five cylinder arrangement, it will be understood by those skilled in the art that a ten cylinder arrangement may also be used to preserve axial dynamic balance, as will any embodiment that has a multiple of five cylinders of equal angular separation arranged around the central axis of rotation. Furthermore profiling of the power and exhaust cams to produce a multiplicity of five-stroke cycles will be balanced in operation in combination with a multiplicity of five cylinder arrangements if the necessary condition for balance of concurrent equal and opposite motion is met.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An engine comprising:

an engine block having a longitudinal dimension and a diameter dimension orthogonal to said longitudinal dimension, said engine block having a linear shaft bore running therethrough along a centroidal axis of symmetry of said block from a power piston end of said block to an opposite exhaust piston end, a radially spaced array of five cylinders formed in said block, equally radially spaced around, and equally radially distal from, and parallel to said shaft bore, a power piston cam cavity formed in said power piston end of said block and connecting said shaft bore with said array of five cylinders, an exhaust piston cam cavity formed in said exhaust piston end of said block and connecting said shaft bore with said array of five cylinders, a shaft rotatably mounted in said shaft bore, five power pistons slidably mounted in said power piston ends of said array of five cylinders, and five exhaust pistons slidably mounted in said exhaust piston ends of said array of five cylinders, wherein each of said power pistons and each of said exhaust pistons in corresponding cylinders of said array of five cylinders have combustion chamber faces in opposed facing relation within each said corresponding cylinder so as to define a combustion chamber between said opposed facing combustion chamber faces, wherein said each of said power pistons has a power piston cam channel formed therein and disposed in registry with said power piston cam cavity, and wherein said each of said exhaust pistons has an exhaust piston cam channel formed therein and disposed in registry with said exhaust piston cam cavity, a power piston cam having an arcuately profiled substantially disc-shaped power piston cam member there-around, said power piston cam mounted to said shaft for rotation therewith and rotatably mounted in said power piston cam cavity so as to slidably mate said power piston cam member simultaneously with said power piston cam channels in said each power piston, an exhaust piston cam having an arcuately profiled substantially disc-shaped exhaust piston cam member there-around, said exhaust piston cam mounted to said shaft for rotation therewith and rotatably mounted in said exhaust piston cam cavity so as to slidably mate said exhaust piston cam member simultaneously with said exhaust piston cam channels in said each exhaust piston, said power piston cam member being arcuately profiled in accordance to a power piston stroke profile to translate said power pistons during a repeating five phase cycle of said engine along said corresponding cylinders as said shaft rotates relative to said block, said exhaust piston cam member being arcuately profiled in accordance to an exhaust piston position profile to translate said exhaust pistons during said five phase cycle of said engine along said corresponding cylinders as said shaft said rotates relative to said block, and wherein said each cylinder has an intake port and a corresponding exhaust port formed in a wall of said each cylinder, said intake port positioned to coincide in position with said combustion chamber during an intake dwell phase of said five phase cycle of said engine, wherein said five phase cycle includes, in repeating sequence: said intake dwell phase, a compression stroke phase, a power stroke phase, an exhaust stroke phase, and a vacuum stroke phase, wherein in said intake dwell phase for said each cylinder said piston is translated according to said stroke profile to an intake port open position wherein a corresponding said intake port is open and said exhaust piston is maintained by said positioning profile in an exhaust port closed position wherein a corresponding said exhaust port is closed so that a combustion mixture fills said combustion chamber from said intake port, wherein in said compression stroke phase for said each cylinder said power piston is translated according to said stroke profile to a fully compressed position wherein said combustion chamber is fully compressed for ignition of said combustion mixture in said combustion chamber, and said exhaust piston is in said exhaust port closed position, wherein in said power stroke phase for said each cylinder said power piston is translated to a power-from-combustion depleted position wherein said combustion chamber is expanded without opening said intake port to thereby transfer energy from combustion of said mixture following said ignition to rotation of said shaft, and said exhaust piston is in said exhaust port closed position, wherein in said exhaust stroke phase for said each cylinder said power piston is translated to substantially said fully compressed position and said exhaust piston is translated to an exhaust port open position wherein said exhaust port is exposed to vent therethrough by-products of combustion from said ignition of said mixture in said combustion chamber, wherein in said vacuum stroke phase for said each cylinder said power piston returns to said intake port open position and said exhaust piston returns to said exhaust port closed position, and wherein said five stroke cycle for said each cylinder is 72 degrees out-of-phase to said five stroke cycle for its next adjacent said cylinder in said array of five cylinders so as to provide for balanced operation of said engine.

2. The engine of claim 1 wherein said shaft is solid and said ports are in fluid communication directly to an exterior of said engine.

3. The engine of claim 1 wherein said shaft is hollow so as to form a linear intake and exhaust conduit and wherein said shaft has apertures formed around said conduit coinciding in longitudinal position with said ports, and wherein said ports are in fluid communication with said conduit via said apertures as said shaft rotates.

4. The engine of claim 1 wherein each said cylinder further comprises an igniter port adjacent a corresponding said exhaust port, an igniter mounted in each said igniter port.

5. The engine of claim 4 wherein said each igniter extends into corresponding said each combustion chamber from said igniter port.

* * * * *